United States Patent [19]

Knowles

[11] 4,145,103

[45] Mar. 20, 1979

[54] CONNECTOR WITH LOW PROFILE LATCH

[75] Inventor: Robert G. Knowles, Litchfield, Conn.

[73] Assignee: Litton Systems, Inc., Oakville, Conn.

[21] Appl. No.: 911,533

[22] Filed: Jun. 1, 1978

[51] Int. Cl.[2] ..... H01R 13/38
[52] U.S. Cl. ..... 339/99 R
[58] Field of Search ..... 339/91 R, 97 P, 98, 339/99 R, 206–210

[56] References Cited

U.S. PATENT DOCUMENTS

| | | | |
|---|---|---|---|
| 3,702,982 | 11/1972 | Kelly et al. | 339/99 R |
| 3,723,948 | 3/1973 | Wyatt et al. | 339/99 R |

FOREIGN PATENT DOCUMENTS

| | | | |
|---|---|---|---|
| 2,541,441 | 4/1976 | Fed. Rep. of Germany | 339/99 R |

*Primary Examiner*—Joseph H. McGlynn
*Attorney, Agent, or Firm*—Brian L. Ribando

[57] ABSTRACT

A metal clip provides a two position latch for a flat cable connector. In the first position of the latch, an upper pressure member is held spaced from a lower contact support. After the cable has been placed in the connector, pressure on the two connector halves will cause a joining thereof to the cable and the catching of the latch to establish the second position. The metal clip provides a latch which is stronger than one made of plastic and which additionally aids in reinforcing the pressure member.

5 Claims, 3 Drawing Figures

Fig_1
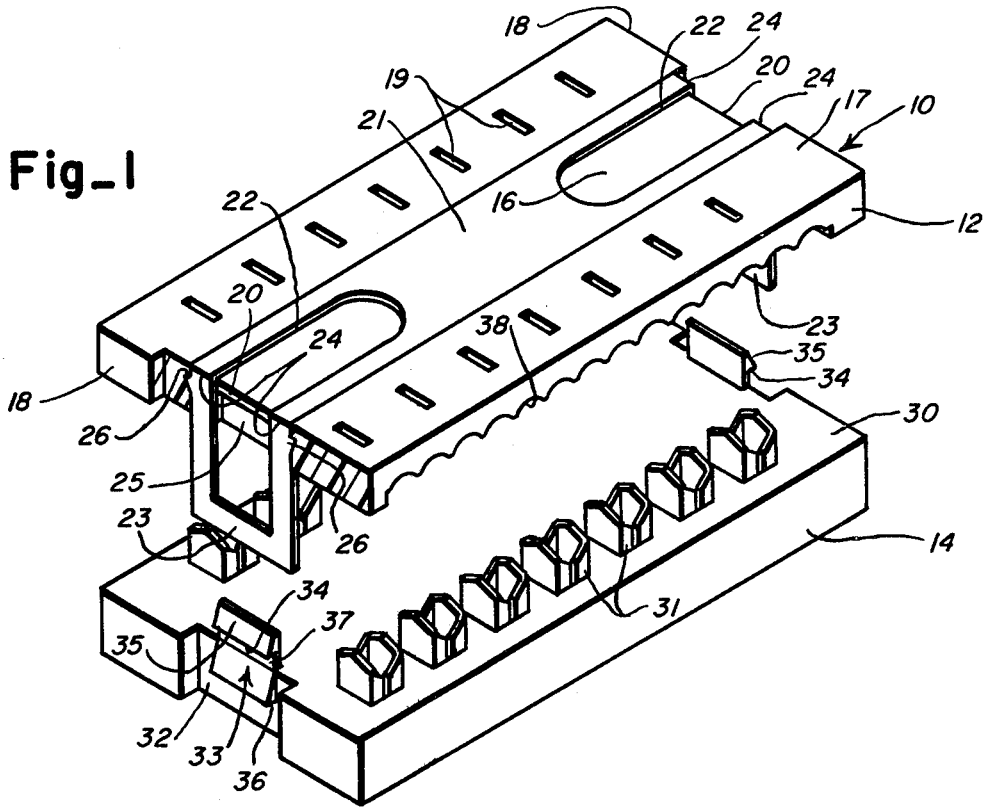
Fig_2
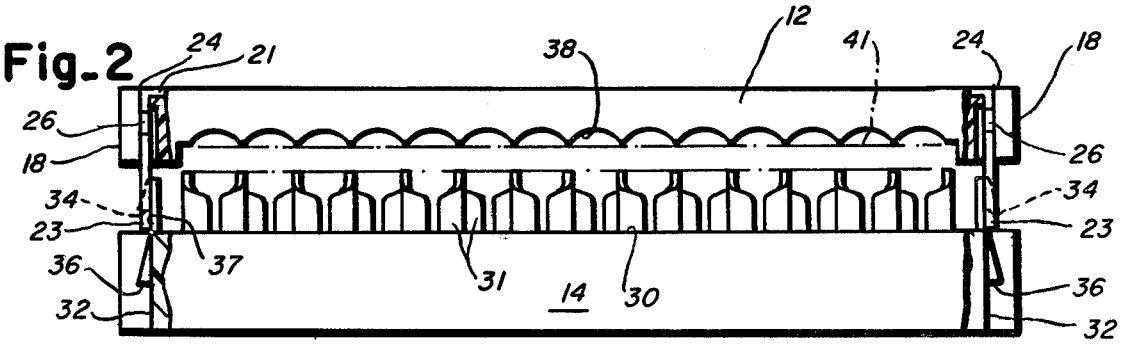
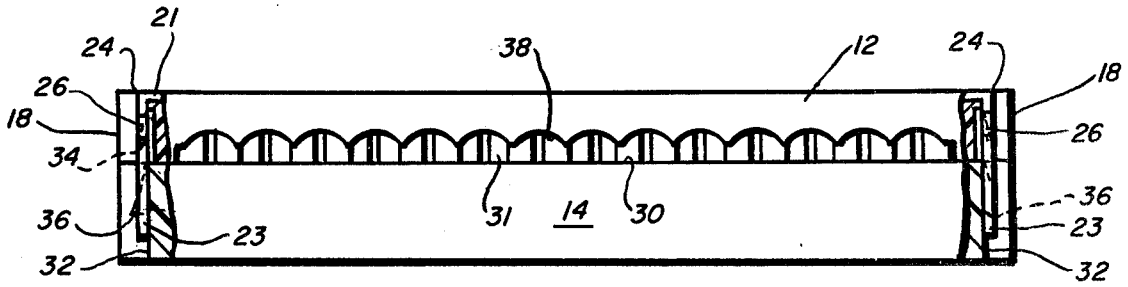
Fig_3

CONNECTOR WITH LOW PROFILE LATCH

BACKGROUND OF THE INVENTION

The invention relates to a two position latch in an insulation displacement connector used in terminating flat insulated multi-conductor cables.

Connectors for flat multi-conductor cable are well known in the prior art. The U.S. Patent to Oshva, U.S. Pat. No. 3,355,699, discloses a ribbon cable connector in which two pressure bars are attached to either side of a central adaptor block. Each pressure bar includes a wedge shaped member over which the ribbon is wrapped and an intermediate contact block includes a plurality of pointed teeth which pierce the insulation on the ribbon cable and make electrical contact with the conductors therein. The Oshva connector includes a metal strain relief which is fastened to the prssure bar by means of jack screws and which is apertured to receive a tab formed on the adaptor block. The tab and apertured strain relief comprise the means for holding the pressure bar to the adaptor block.

The U.S. Patent to Narozny, U.S. Pat. No. 4,027,941, shows an apparatus for terminating a flexible cable which comprises a base member, a cover member, a contact plate, and a retainer plate. The cable to be terminated is placed between the contact plate and the retainer plate and the cover member is pressed to the base member in order to effect a locking together of the said two members and to establish electrical contact between the apparatus and the cable. A lip is provided on each side of the cover member to mate with one of two parallel slots formed on the base member. With the lip in the first slot, the cover is retained to the base, but room is available for a cable to be inserted into the connector. With the lip in the second slot, the contact plate is in piercing engagement with the cable and an electrical connection is effected. The lip in the Narozny structure is integral with the cover which is plastic and is prone to breakage from strain. Similarly, the twin slots on the base member are formed in an extension of the member itself and, therefore, comprise plastic material which is also subject to breakage.

The U.S. Patent to Hudson, Jr., U.S. Pat. No. 4,068,912, shows a cable clamping insulation displacing electrical connector in which an alligator-type jaw is used to hold a cable in proper orientation for receiving a plurality of insulation piercing contact members which are mounted in a base piece. The alligator jaw structure attaches to the base piece by means of apertures formed in latch legs which are caught by detents formed on the base piece. The latch legs are formed of plastic and subject to breakage due to bending stresses created when the latch leg flexes in order to clear the detent.

The U.S. Patent to Huffnagle et al, U.S. Pat. No. 3,820,055, shows a multi-contact connector for flat cable cmprising a cap and a base wherein a plurality of insulation piercing electrical contact members are mounted in the base. Plastic latching arms attached to the base include enlarged free ends which enter and lock in mating recesses formed in the cap. The Huffnagle et al device and locking structure comprise plastic which is prone to breakage in normal use.

SUMMARY AND OBJECTS OF THE INVENTION

A metal clip is provided with cut-outs to create a two position latch for a flat cable connector. The clip is mounted in a channel in an upper pressure member of the connector, and in the first position of latching is spaced from a lower contact support. The lower support mounts a plurality of insulation displacing connectors, and in the first position of latching, sufficient clearance space is maintained between the upper pressure member and the lower contact support to allow the placement of a multi-conductor flat cable therebetween. Once the cable has been properly positioned in the device, the two halves of the connector may be pressed together causing the latch to become caught on the second catch which is formed on the contact support. In this position, electrical connection is established between the plurality of insulation displacement contacts and the conductors within the flat cable. The metal latch resists breakage which is a common problem found in the plastic latches of similar devices and additionally provides a reinforcing member for the upper pressure member.

It is therefore an object of the present invention to provide a two-piece connector with a low profile two-position latch to be used in terminating flat multi-conductor cables.

It is another object of the invention to provide a two-piece plastic connector for use with flat multi-conductor cables wherein the connector comprises an upper pressure member including a metal latch and a lower contact support for mounting a plurality of insulation displacement contacts and including a two-position catch.

These and other objects of the invention will become apparent from the following detailed description taken in conjunction with the accompanying drawing figures in which like reference numerals designate like or corresponding parts throughout the figures.

BRIEF DESCRIPTION OF THE DRAWING

FIG. 1 is a perspective view partly in section showing a connector having a two-position low profile latch;

FIG. 2 is side view partly in section of the connector in FIG. 1 showing the latch in the first latching position; and FIG. 3 is a side view partly in section of the connector of FIG. 1 showing the latch in the second latching position.

DESCRIPTION OF THE PREFERRED EMBODIMENT

Referring now to the drawing, there is shown in FIG. 1 a connector with a low profile latch generally designated by the reference numeral 10. The connector comprises an upper pressure member 12 and a lower contact support 14. The upper pressure member 12 is generally rectangular in shape and includes a channel 16 formed along the length of the top surface 17 and channels 20 extending down opposite sides 18. The channels 20 each include a recess 25 and the upper pressure member includes a plurality of probe access slots 19 which are provided to allow a test instrument to be inserted therein once the connector is closed.

Disposed in the channels 16 and 20 is a metal clip 21. The clip 21 is provided with cut-outs 22 at either end thereof. The cut-outs 22 form at the extreme ends of the clip 21 latch portions 23. Knees 24 are formed where the clip 21 is bent in order to follow the contour of the channels 16 and 20 which are cut in the upper pressure member 12. Barbs 26 are integrally formed in the sides of the clip 21 between the knees 24 and the latch portions 23. In order to mount the clip 21 on the upper pressure member 12, the clip need only be aligned with the channels 16 and 20 and then pressed to the top surface 17 of th upper pressure member 12. The cut-outs 22 allow the clip to flex in the region of the barbs 26 enabling the barbs 26 to enter the channels 20. Removal of the clip 21 from the channels 16 and 20 is prevented, however, by the barbs 26 which bite into the plastic of the pressure member adjacent the channels 20 to provide adequate retention therein.

A plurality of insulation displacing contacts 31 are mounted in a top surface 30 of the lower contact support 14. Channels 32 are formed on either end of the lower contact support so as to be in alignment with the channels 20 formed on the ends 18 of the upper pressure member. Partially positioned within each channel 32 is a two-stage detent 33 which comprises a first catch 34 and a second catch 36. The two catches are separated by a support section 37 which positions a bevel 35 above the upper surface of the lower contact support 14.

Turning now to FIG. 2, it will be seen that with the latch portion 23 of the clip 21 positioned on the support section 37, sufficient space exists between the insulation displacing contacts 31 and a sculpted surface 38 for a flat multi-conductor cable 41, shown in phantom, to be positioned. The latch portions 23 are retained on the support sections 37 by the first catch 34.

Turning now to FIG. 3, the latch portions 23 of the clips 21 are shown in the second latching position, trapped therein by the second catches 36 and the bevel portions 35 of the detents 33 are received by the recesses 25. The second catches prevent separation of the upper pressure member 12 from the lower contact support 14 and additionally provide the required locking force to maintain the insulation displacing contacts 31 in contact with the plurality of conductors within the cable 41 (not shown).

The use and operation of the two-position latch will be apparent to those skilled in the art. The connector may be put into the first locking position by aligning the upper pressure member 12 above the lower contact support 14 with the latch portions 23 of the clip 21 being located in the channels 32 which are adjacent the top surface 30. A slight force applied to the pressure member 12 will cause the latch portions 23 to ride on the bevels 35 until snapping past the first catches 34 and onto the support surfaces 37. The resilience of the metal clip will cause the latch portions 23 to bear firmly against the support surfaces 37. Accidental withdrawal of the upper pressure member from the lower contact support is made impossible by the first catch which prevents the withdrawal of the latch portions 23 therepast. The connector may be stored with the latch in the first position indefinitely, and the upper pressure member will be retained thereon.

When it is desired to terminate a multi-conductor cable, the dimensioning of the latch allows a cable to be placed between the upper pressure member and the plurality of insulation displacing contacts 31 even though the latch is retained on the support surface 37 by the first catch 34. Once the cable is in the proper position, force applied to the upper pressure member will cause the sculpted surface 38 of the same to bear on the multi-conductor cable and to push the same into mating contact with the piercing members formed on the plurality of contacts 31. As the upper pressure member 12 approaches the lower contact support 14, the contacts 31 will cut through the insulation of the cable 41 to establish an electrical connection with the metallic conductors which are located therein. As latch portions 23 of the clip ride downwardly on the support surface 37, the latch 23 will snap past the second catch 36. The resilience of the clip 21 will maintain the latch portions 23 firmly against the channel 32 and the upper pressure member will be locked to the lower contact support, accidental separation of the two pieces being virtually impossible.

Having thus described the invention, various alterations and modifications thereof will occur to those skilled in the art, which modifications and alterations are intended to be within the scope of the present invention as defined in the appended claims.

I claim:

1. In a connector for terminating flat multi-conductor cables including a lower contact support mounting a plurality of insulation displacement contacts and an upper pressure member, the combination comprising:

a clip means for reinforcing said upper pressure member for securing said upper pressure member to said lower contact support in two positions, a first channel means formed along the top and two opposite ends of said upper pressure member for receiving said clip means therein, second and third channel means located on opposite ends of said lower contact support, latch means formed on both ends of said clip means, a detent partially positioned in each of said second and third channel means, support section means formed on said detent for supporting said latch means in a first position, first catch means for preventing withdrawal of said latch means from said support section means, and second catch means for preventing withdrawal of said latch means from a second position.

2. The combination of claim 1 further comprising:

bevel means on said detent positioned above the surface of said lower contact support, and recess means in said upper pressure member for receiving said bevel means.

3. The combination of claim 1 further comprising:

a cut-out formed in either end of said clip, and means formed on said clip adjacent said cut-out for securing said clip in said first channel.

4. The combination of claim 3 further comprising:

a metal clip comprising said clip means, and knees formed in said clip by bending said clip at right angles to itself, said knees being located on said clip in the region of said means for securing.

5. The combination of claim 4 further comprising:

barbs integrally formed on said clip comprising said means for securing, said barbs being positioned on said clip between said knees and said latch means.

* * * * *